United States Patent [19]

Roberts

[11] Patent Number: 4,664,060

[45] Date of Patent: May 12, 1987

[54] PAINT SPRAY BOOTH

[75] Inventor: Jessie E. Roberts, Mt. Clemens, Mich.

[73] Assignee: Arthur B. Myr Industries, Inc., Belleville, Mich.

[21] Appl. No.: 803,070

[22] Filed: Nov. 29, 1985

[51] Int. Cl.[4] ..... B05B 15/12

[52] U.S. Cl. ..... 118/326; 118/DIG. 7; 261/DIG. 54; 55/240; 55/241; 98/115.2

[58] Field of Search ..... 118/326, DIG. 7; 261/DIG. 54; 55/240, 241; 98/115.2

[56] References Cited

U.S. PATENT DOCUMENTS

| | | | |
|---|---|---|---|
| 3,112,352 | 11/1963 | Krantz | 261/DIG. 54 X |
| 3,170,007 | 2/1965 | Krantz | 55/241 X |
| 3,347,024 | 10/1967 | Dock et al. | 55/241 |
| 3,567,194 | 3/1971 | Shah et al. | 261/DIG. 54 X |
| 3,793,809 | 2/1974 | Tomany et al. | 55/241 X |
| 4,257,784 | 3/1981 | Gebhard et al. | 261/DIG. 54 X |
| 4,299,602 | 11/1981 | Cordier et al. | 118/326 X |
| 4,345,921 | 8/1982 | Gustavsson et al. | 261/DIG. 54 |
| 4,425,870 | 1/1984 | Marshke | 118/326 |
| 4,440,554 | 4/1984 | Perry | 261/DIG. 54 X |
| 4,582,515 | 4/1986 | Eneroth et al. | 261/DIG. 54 X |

*Primary Examiner*—Shrive P. Beck

*Attorney, Agent, or Firm*—Gifford, Groh, VanOphem, Sheridan, Sprinkle & Dolgorukov

[57] ABSTRACT

A paint spray booth for painting articles, such as motor vehicles, having a housing with a bottom, a substantially horizontal floor spaced upwardly from the bottom and in which the floor divides the housing between an upper housing chamber and a lower housing chamber. The floor is flooded with water while a plurality of air scrubber units extend through the floor and fluidly connect the housing chambers together. Simultaneously, air is inducted from the upper chamber, through the air scrubber units and into the lower chamber so that the air scrubber units intermix the water and air together and so that paint particles entrained within the air become entrapped within the water. Each air scrubber utilizes a venturi to intermix the air and water together.

6 Claims, 4 Drawing Figures

Fig-3
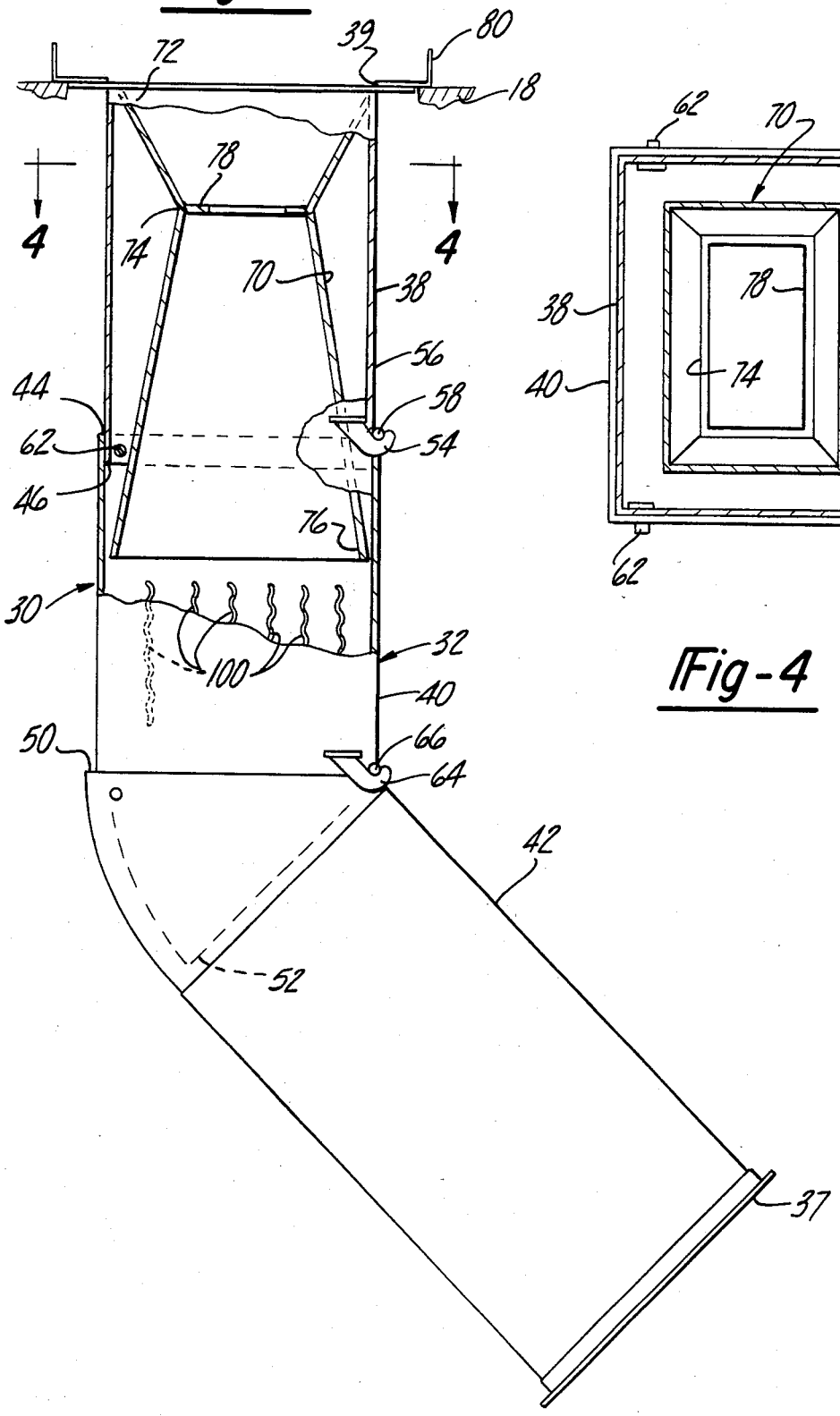
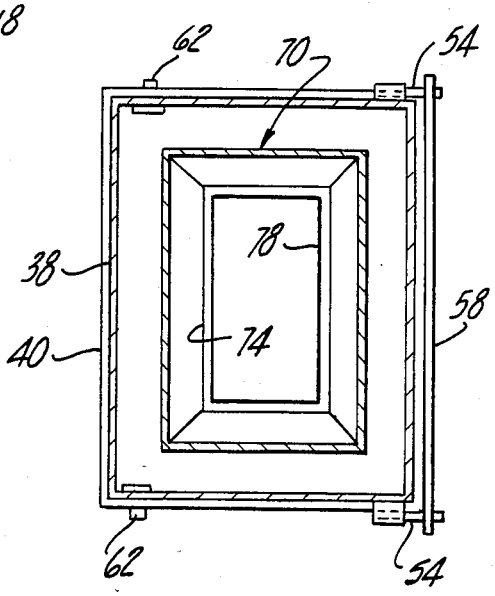
Fig-4

PAINT SPRAY BOOTH

BACKGROUND OF THE INVENTION

I. Field of the Invention

The present invention relates to a paint spray booth for spray painting articles, such as motor vehicles.

II. Description of the Prior Art

The previously known paint spray booths which are used to paint articles, such as motor vehicles, typically comprise an elongated housing having sidewalls and a horizontal floor which divides the housing into an upper chamber and a lower chamber. The articles are conveyed through the upper chamber of the paint spray booth by a conveyor system on the floor so that the articles are longitudinally spaced from each other along the conveyor system. These articles are spray painted as they are conveyed through the upper housing chamber.

These previously known paint spray booths, furthermore, typically include a plurality of longitudinally spaced air scrubber units which are positioned at longitudinally spaced intervals along the floor. These air scrubber units fluidly connect the upper and lower housing chambers to each other. In operation, fans induct air laden with paint particles from the upper chamber, through the air scrubber units and into the lower chamber. Simultaneously, water is introduced to the air scrubber units which mixes the water and air together. In doing so, paint particles entrained within the air become entrapped within the water which pollutes the water and simultaneously purifies the air. The purified air is exhausted to the atmosphere while the polluted water is collected and conveyed to a sludge and/or water filtration system.

These previously known paint spray booths, however, all suffer from a number of common disadvantages. A primary disadvantage of many of these previously known paint spray booths is that the floor which divides the paint spray booth into its upper and lower housing chambers is spaced upwardly from the bottom of the paint spray booth by eight or more feet. Such wide vertical spacing of the floor from the bottom of the paint spray booth is necessary to enable the air scrubber units to completely intermix the air and water together in order to adequately purify the air prior to its exhaust to the atmosphere. This high vertical height of the floor greatly increases the overall cost of the paint spray booth and its installation.

A still further disadvantage of many of these previously known paint spray booths is that the air scrubber units are complicated and expensive in construction. Furthermore, since these previously known air scrubber units are of integral construction, in the event that a component of the air scrubber units gets damaged, the entire air scrubber unit oftentimes must be replaced. This increases the overall cost of maintenance of the air scrubber units.

A still further disadvantage of these previously known air scrubber units is that they inadequately intermix the air and water together so that a portion of the paint particles remain entrained in the air even after the air passes through the air scrubber units and into the lower housing chamber. This is particularly critical for paint spray booths since, due to government regulations, only a very small amount of paint is permitted to remain in the air as it is exhausted from the paint spray booth.

SUMMARY OF THE PRESENT INVENTION

The present invention provides a paint spray booth which overcomes all of the above mentioned disadvantages of the previously known paint spray booths.

In brief, the paint spray booth according to the present invention comprises a housing having a horizontal floor which, like the previously known paint spray booths, divides the housing into an upper chamber and a lower chamber. The articles, such as motor vehicles, to be painted are conveyed through the upper chamber by a conventional conveyor system and these articles are spray painted in the conventional fashion.

A plurality of longitudinally spaced air scrubber units are open to the floor along the conveyor system and these air scrubber units establish a fluid communication between the housing upper and lower chambers. These air scrubber units are preferably open along both sides of the articles which are painted so that, as air is inducted from the upper housing chamber and through the air scrubber units, the paint laden air does not accumulate on the conveyor system.

As the air is inducted from the upper housing chamber, through the air scrubber units and to the lower housing chamber, the upper surface of the floor is flooded with water and this water enters into each air scrubber unit. Each air scrubber unit includes a venturi which creates turbulence in the air and water flow through the air scrubber unit in order to mix the air and water together. Preferably, a lip extends inwardly in the throat or narrowest portion of the venturi in order to further facilitate the intermixing of the air and water together.

In operation, as the air and water is intermixed within the air scrubber units, the paint particles entrained within the air become entrapped within the water and this air/water mixture is exhausted into the lower housing chamber. The now polluted water is collected in the lower housing chamber and conveyed to a suitable sludge or filtration system while the purified air is exhausted to the atmosphere.

Unlike the previously known air scrubber units, the air scrubber unit of the present invention preferably comprises three housing sections or ducts. An upper duct is secured to the floor and encloses substantially all of the venturi. An intermediate duct and a lower duct are connected in series below the upper duct and all three ducts are detachably secured together. Thus, in the event that one duct becomes damaged or requires cleaning, it can be easily and simply removed and/or replaced without replacing the entire air scrubber unit. In addition, the lowermost duct preferably is angled with respect to the axis of the upper and intermediate ducts which minimizes the space in between the bottom of the housing and the floor.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 3 is a longitudinal partial sectional view of the preferred embodiment of the one scrubber unit of the present invention; and FIG. 4 is a cross sectional view taken substantially along line 4—4 in FIG. 3.

DETAILED DESCRIPTION OF A PREFERRED EMBODIMENT OF THE PRESENT INVENTION

Figure 1:
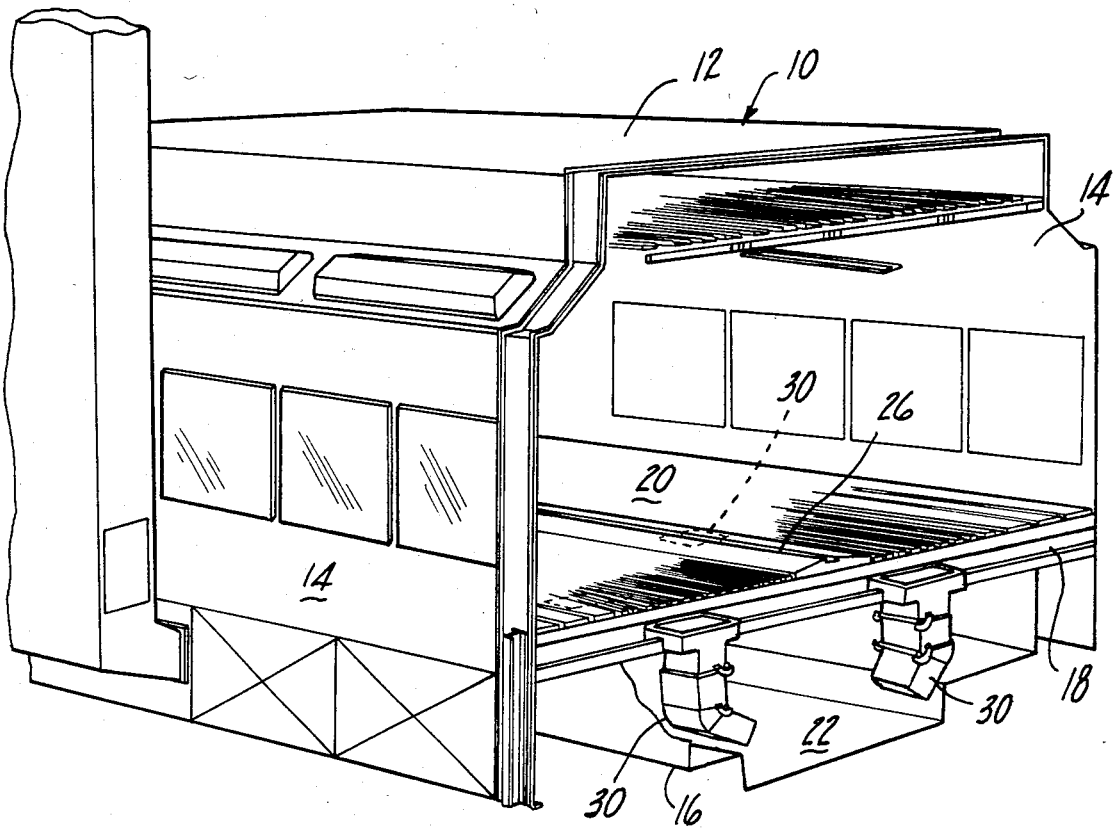
FIG. 1 is perspective view illustrating a preferred embodiment of the present invention.
Figure 2:
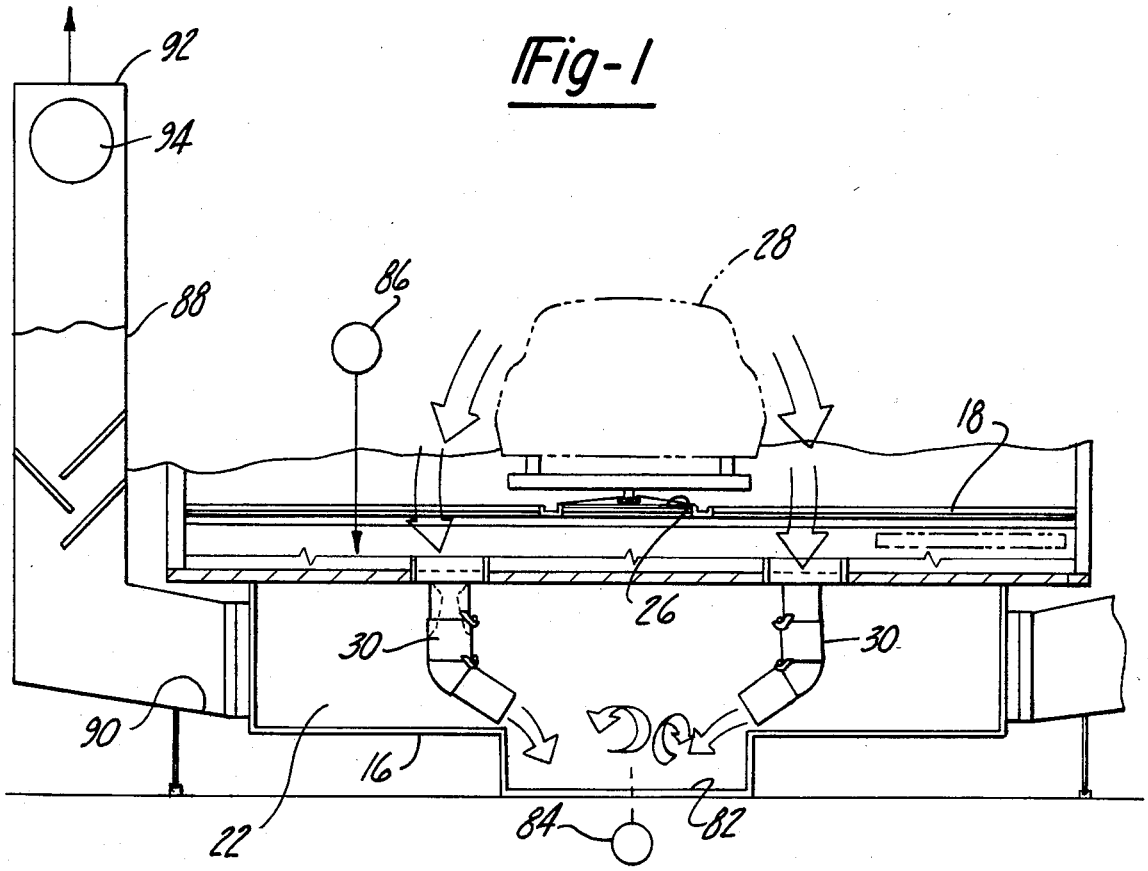
FIG. 2 is a diagrammatic end view of the preferred embodiment of the present invention.

With reference first to FIGS. 1 and 2, a preferred embodiment of the paint spray booth according to the present invention is thereshown and comprises an elongated housing 10 having a top 12, sidewalls 14 and a bottom 16. A horizontal floor 18 extends across the housing and is spaced upwardly from the housing bottom 16 thus forming an upper housing chamber 20 and a lower housing chamber 22.

An elongated conveyor system 26, illustrated only diagrammatically, is mounted to the top of the floor 18 so that the conveyor system 26 extends longitudinally through the housing 10. The conveyor system 26 is conventional in construction and is used to transport the articles, such as motor vehicles 28 (FIG. 2), which are to be painted longitudinally through the upper housing chamber 20. It will be understood, however, that the paint spray booth of the present invention can be used to spray paint articles other than motor vehicles 28.

With reference still to FIGS. 1 and 2, a plurality of air scrubber units 30 are mounted to the floor at longitudinally spaced intervals therealong. In addition, the air scrubber units are preferably arranged in transversely aligned pairs along the floor 18 so that, for each pair of transversely aligned air scrubber units 30, one air scrubber unit 30 is open along one side of the vehicle 28 while the other air scrubber unit 30 is open along the other side of the vehicle 28.

With reference now particularly to FIG. 3, an air scrubber unit 30 is thereshown in greater detail and comprises a duct assembly 32 having an open upper end 34 and an open lower end 36. The duct assembly 32 is preferably constructed from three duct sections, namely an upper duct section 38, an intermediate duct section 40 and a lower duct section 42. An open upper end 44 of the intermediate duct section 40 is secured to a lower open end 46 of the upper duct sections 38 so that the duct section 38 and 40 are connected in series with each other. Similarly, an open upper end 50 of the lower duct section 42 is connected to an open lower end 52 of the intermediate duct section 40 so that all three duct sections 38, 40 and 42 are connected in series between the upper or inlet end 39 and the lower or outlet end 37 of the duct assembly 32. Furthermore, each duct section, 38, 40 and 42 is preferably rectangular in cross sectional shape.

Referring now to FIGS. 3 and 4, although any means can be used to detachably secure the duct sections 38, 40 and 42 to each other, preferably the upper duct section 38 includes a pair of hooks 54 which are secured to the bottom of the upper duct section 38. The hooks 58 are spaced apart and aligned with each other and extend outwardly from one side 56 of the upper duct section 38. An elongated rod 58 is then attached along one upper edge of the intermediate duct section 40. This rod 58 is engaged by the hooks 54 thus attaching one side of the intermediate duct section 40 to one side of the upper duct section 38. A spring loaded pin assembly 62 then attaches the other side of the intermediate duct section 40 opposite from the rod 58 to the upper duct section 38. This spring loaded pin 62 which is conventional in construction, thus enables the upper duct section 38 and intermediate duct sections 4 to be rapidly and easily attached together and detached from each other.

A pair of hooks 64 (only one shown), rod 66 and spring loaded pin assembly 68 are employed in a similar fashion to attach the intermediate duct section 40 and lower duct section 42 together.

As best shown in FIG. 3, the upper and intermediate duct sections 38 and 40, respectively, each have an axis which is substantially perpendicular to the plane of the floor 18. However, the lower duct section 42 has a longitudinal axis which intersects the axes of the upper and intermediate duct sections 38 and 40 at an angle of between 20 and 30 degrees. This construction thus effectively lengthens the overall length of the duct assembly 32 while enabling the spacing between the floor 18 and the bottom 16 of the housing 10 to be kept at a minimum.

Referring now to FIGS. 3 and 4, an elongated venturi 70 having an inlet end 72 of a predetermined cross sectional area is mounted within the duct assembly 32 so that its inlet end 72 is positioned adjacent the upper end 39 of the upper duct section 38. The sides of the venturi 70, however, taper towards each other down to a throat 74 of the venturi 70 which has a cross sectional area less than the venturi inlet 72. From the throat 72, the sides of the venturi 70 taper outwardly from each other to an outlet end 76 which has a cross sectional area greater than the throat 74.

The entire venturi 70 is preferably retangular in cross sectional shape and each of the four sides of the venturi 70 is planar in construction. In addition, a lip 78 protrudes inwardly into the interior of the venturi 70 at the venturi throat 74 so that the plane of the lip 78 is substantially perpendicular to the axis of the venturi 70. This lip 78 preferably extends entirely around the throat 74 and its purpose will be subsequently described.

With reference now to FIG. 3, each air scrubber unit 30 includes a dam or weir 80 which extends entirely around the open upper end 39 of the duct assembly 32 and thus around the inlet 72 to the venturi 70. The weir 80 protrudes upwardly from the floor 18 by a relatively small amount, for example an inch or two.

With reference now to FIG. 2, the air scrubber units 30 are secured to the floor 18 so that the outlet end 36 from the duct assembly 32 is open to a water return trough 82 which is formed along the bottom 16 of the housing 10. The water return trough 82 is fluidly connected a sludge collection and water filtration system 84 which removes solid impurities, i.e., paint particles, from the water.

At least one water pump 86 (illustrated only diagrammatically) continuously pumps water to the upper surface of the floor 18. The inlet to the water pump 84 can be connected to either a fresh water source or, alternatively, to the output from the water filtration system 84.

At least one and typically several air exhaust flues 88 each have an inlet end 90 which is open to the lower housing chamber 22 and an exhaust or outlet end 92 which is open exteriorly to the atmosphere. An exhaust fan 94 is mounted adjacent the outlet end 92 of each flue 88 so that, upon activation, the fans 94 induct air from the housing upper chamber 20, through the air scrubber 30 and into the lower housing chamber 22.

In operation, the water pumps 86 and exhaust fans 94 are continuously activated. The water pumps must provide a supply of water to the upper surface of the floor 18 which causes the upper surface of the floor 18 to flood until the water flows over the weirs 80 which surround the upper end of each air scrubber unit 30. Once the water level exceeds the height of the weir 80, the water flows over the weir 80 and into the inlet end 72 and into the venturi 70.

Since both the water pump 86 and the exhaust fan 94 are continuously activated, a continuous supply of air and water is inducted into the inlet end 72 of the venturi 70. This air/water mixture flows from the inlet end 72 and towards the reduced area throat 74 of the venturi 70 which increases the velocity of the air/water mixture in the well known fashion. At the venturi throat 74, this air water mixture impinges upon the lip 78 which deflects the air/water mixture from all sides of the venturi 70 and towards the center of the venturi throat 74. The lip 78, together with the flow acceleration caused by the venturi 70, creates a great amount of turbulence within the venturi 70 which is inducted down through the duct assembly 32 and exhausts through its lower end 37. The venturi 70, utilizes venturi slot size for controlling the static pressure and volume.

During a paint spray operation, the air inducted into the air scrubber unit 30 by the fans 94 is laden with paint particles and the intermixing of water and air caused by the venturi 70 and its lip 78 intermixes the water and air and entraps the paint particles within the water thus purifying the air and, simultaneously, polluting the water. This polluted water is then collected by the water return trough 82 and processed by the water filtration and sludge removal system 84 and the purified air is exhausted to the atmosphere.

If greater intermixing of the air and water is desired or required, baffles 100 (FIG. 3) can be installed below the venturi throat to enhance the intermixing and increase efficiency.

From the foregoing, it can be seen that the paint spray booth according to the present invention overcomes many disadvantages of the previously known paint spray booths.

In particular, the modular construction of the duct assembly 32 allows the duct assembly 32 to be easily separated into the separate components or duct sections 38, 40 or 42 for replacement, repair and/or cleaning as required. Thus, in the event that a single duct section becomes damaged beyond repair, it is only necessary to replace that single duct section rather than the entire air scrubber unit.

A still further advantage of Applicant's invention is its provision of the venturi 70 with its inwardly extending lip 78 which creates a great amount of turbulence in the air/water mixture within the venturi 70. In practice, this intermixing of the air and water has proven adequate to almost entirely purify the air by removing paint particles.

In the event, however, that further purification of the air is desired, one or more baffles can be installed within either the intermediate duct section 40 or lower duct section 42 which creates further turbulence and intermixing of the air/water.

A further advantage of Applicant's invention is that, since the axis of the lower duct section 42 intersects the axis of the upper two duct sections 38 and 40 at an angle of between 20 and 30 degrees, a relatively short space in between the floor 18 and bottom 16 of the housing 10 is obtained while maintaining a long effective length of the duct assembly 32. Such a relatively long length of the duct assembly 32 is highly desireable in order to ensure complete intermixing of the air and water.

A still further advantage of Applicant's invention is that the entire floor 18 is flooded with water thereby simplifying the overall design of the water supply system without adversely affecting the efficiency of the air scrubber units.

Having described my invention, however, many modifications thereto will become apparent to those skilled in the art to which it pertains without deviation from the spirit of the invention as defined by the scope of the appended claims.

I claim:

1. A paint spray booth for spray painting articles comprising:

a housing having a bottom and a substantially horizontal floor spaced upwardly from the bottom, said floor forming an upper housing chamber and a lower housing chamber, the articles to be painted being positioned in said upper chamber, means for supplying water to an upper surface of said floor, air scrubber means open through said floor and fluidly connecting said housing chambers for intermixing water and air, means for inducting an air/water mixture from said upper chamber through said air scrubber means and into said lower chamber, means contained in said lower chamber for collecting and removing water inducted into said lower chamber, wherein said air scrubber means comprises an elongated duct assembly open at each end and forming an air/water passageway, a venturi contained in said duct assembly and in series with said air/water passageways, said venturi having an inlet end and an outlet end, said inlet end being of a first predetermined area, a throat intermediate said ends, said throat having a second predetermined area less than said first predetermined area, and said outlet end having an area greater than said second predetermined area wherein said venturi comprises an inwardly extending lip at said throat, said lip having a plane substantially perpendicular to the axis of said venturi and extending entirely around said throat, wherein said duct assembly comprises an upper duct having an upper end secured to said floor, said venturi being contained in said upper duct, an intermediate duct, means for detachably securing an upper end of said intermediate duct to a lower end of said upper duct, a lower duct, and means for detachably securing an upper end of said lower duct to a lower end of said intermediate duct and a plurality of baffles disposed in said intermediate duct.

2. The invention as defined in claim 1 wherein said

3. The invention as defined in claim 1 wherein a lonventuri is rectangular in cross sectional shape.

4. The invention as defined in claim 1 wherein a longitudinal axis of said lower duct intersects a longitudinal axis of said intermediate duct at an angle of between 20 and 30 degrees.

4. The invention as defined in claim 1 wherein each of said detachable securing means comprises a hook on one side of one duct which engages a rod on one side of the adjacent duct, and a pin on the other side of one duct which engages a hole in the other side of the other duct.

5. The invention as defined in claim 1 wherein each of said detachable securing means comprises quick release detachable securing means.

6. The invention as defined in claim 1 and comprising a weir surrounding the inlet end of each duct assembly and means for flooding said upper surface of said floor.

* * * * *